United States Patent [19]

Mannino

[11] 4,456,432

[45] Jun. 26, 1984

[54] EMERGENCY SUMP PUMP AND ALARM WARNING SYSTEM

[75] Inventor: Vincent Mannino, Sterling Heights, Mich.

[73] Assignee: Jennings Pump Company, Utica, Mich.

[21] Appl. No.: 469,834

[22] Filed: Mar. 1, 1983

Related U.S. Application Data

[63] Continuation of Ser. No. 200,829, Oct. 27, 1980, abandoned.

[51] Int. Cl.[3] ..... F04B 49/08; F04B 49/02; F04B 21/00

[52] U.S. Cl. ..... 417/2; 417/63; 417/360

[58] Field of Search ..... 116/3; 340/602, 326, 340/331; 361/163; 417/40

[56] References Cited

U.S. PATENT DOCUMENTS

| | | | |
|---|---|---|---|
| 2,797,343 | 6/1957 | Macchi et al. | 361/163 X |
| 2,888,669 | 5/1959 | Thomas et al. | 340/326 |
| 3,681,753 | 8/1972 | Whalen et al. | 340/623 X |
| 3,726,606 | 4/1973 | Peters | 417/40 X |
| 3,786,464 | 1/1974 | Staempfli | 340/623 |
| 3,814,544 | 6/1974 | Roberts et al. | 417/40 |
| 3,911,425 | 10/1975 | Muncheryan | 340/326 |
| 4,087,204 | 5/1978 | Niedermeyer | 417/38 X |
| 4,227,862 | 10/1980 | Andrew et al. | 417/12 |
| 4,276,542 | 6/1981 | Russ | 340/371 X |

*Primary Examiner*—William L. Freeh
*Attorney, Agent, or Firm*—Remy J. VanOphem

[57] ABSTRACT

A battery powered auxiliary sump pump is described which is a backup to the primary sump pump. The auxiliary sump pump provides an intermittent audible alarm and an intermittent visual alarm when the auxiliary sump pump is activated. Thus, the device provides an intermittent audible and visual alarm signal which is more perceptible to an observer than a continuous alarm.

15 Claims, 10 Drawing Figures

EMERGENCY SUMP PUMP AND ALARM WARNING SYSTEM

This is a continuation of application Ser. No. 200,829, filed Oct. 27, 1980 now abandoned.

FIELD OF THE INVENTION

This invention relates generally to a fluid pumping apparatus and specifically to a backup sump apparatus that has an alarm system which is operated in event of power failure of the primary system or to assist the primary system when the same is overloaded.

BACKGROUND OF THE INVENTION

The ever increasing urbanization of society has resulted in increasing problems for owners or leasers of structures. For example, dwelling units, built on undesirable property, have seepage problems which must be accommodated by a sump apparatus. In addition, the building explosion has resulted in an increased percentage of ground area in an urban location being utilized for housing thereby reducing the capacity of the ground to soak up precipitation. Therefore, minor flooding in basements of dwelling places and commercial buildings has become common place in a large number of urban areas. Such minor flooding would normally be accommodated by the sump pump systems heretofore known in the prior art. However, with the increasing urbanization, the inability of the public utilities to keep pace with the power requirements, has resulted in power shortages. Furthermore, as will quite frequently happen, a storm causing the precipitation may cut off, temporarily, the power supply necessary for operating such known prior art sump pump systems.

A result of the foregoing is that in such situations as "brown outs", sufficient power to operate such known prior art sump pump systems may not be available. The result is that the known prior art sump pump systems may not be able to pump out normal seepage, whether or not a storm is taking place, with the result that a basement or crawl space may flood. Similarly, power failures due to storms result in the inability of such known prior art sump pumps to operate at precisely the time required to pump the accumulating water. This results in flooded basements or crawl spaces.

In an attempt to solve this problem, various known prior art battery-powered sump pumps have been designed. Many have controls which will continuously warn of malfunctions in the main pump or the operation of the backup pump.

For example, Karl O. Niedermeyer in U.S. Pat. No. 3,999,980 and U.S. Pat. No. 4,087,204 discloses battery-powered sump pumps. In one embodiment shown in FIGS. 5 of U.S. Pat. Nos. 3,999,980 and 4,087,204, a battery-powered sump pump responsive to a pressure actuator is disclosed. The pressure actuator, when activated, energizes the motor, a signal light and a horn indicating that the sump pump is working. In addition, the electric motor is placed in series with a fuse to protect the electric motor from overload conditions. Push buttons are also incorporated to check the operation of the device and to assist in determining component failures when the pressure actuator is not activated. Also, it is possible to disconnect the power to the horn when desired. Thus, Niedermeyer discloses a battery-powered sump pump which provides a continuous visible indication of operation and, if desired, a continuous audible alarm.

Richard J. Roberts et al, in U.S. Pat. No. 3,814,544, issued June 4, 1974, discloses a self-contained auxiliary battery-powered sump pump which is activated in response to a float switch. The sump pump includes an electrical battery charger for maintaining the battery in condition to operate the pump. In addition, a battery condition indicator, a charger operating light, a manual test switch for actuating the sump pump and a timer unit for automatically operating the unit through a test cycle is disclosed. An alarm bell is provided which is energized to provide an audible alarm when the pump is energized by the float switch. A cut off switch is provided for the alarm bell so that after it announces the energization of the pump due to the condition of the sump, the bell may be deenergized.

Anthony Peters, in U.S. Pat. No. 3,726,606 issued Apr. 10, 1973, discloses an auxiliary sump pump operated by a D.C. motor which is operated in response to a float switch. The pump includes a battery charging system for the storage battery which includes a warning system. The warning system includes an indicator light which is connected to the alternating current power so as to indicate that power is available to the battery charger. Also, included is an alarm which is activated upon a power failure which can be de-activated by a switch once its warning has been communicated to the observer.

All the above described prior art designs provide for a continuous audible or visual signal to indicate the operation of the auxiliary sump pump in response to some liquid level responsive device. None of the above designs, however, provide an intermittent audible and visual signal which is more perceptible to an observer than a continuous alarm. In addition, none provide an intermittent visual alarm which may be perceived by users who are deaf or hard of hearing and in the alternative provide an intermittent audible alarm which may be perceived by users who are blind or have impaired sight.

SUMMARY OF THE INVENTION

The present invention is directed to a battery-powered sump pump which provides an intermittent audible and intermittent visual signal which may be more easily perceived by an observer so as to warn the observer of the operation of the auxiliary sump pump. In addition, the device provides an intermittent visual signal which may be perceived by an observer with an audible handicap and the device also has an intermittent audible alarm which may be perceived by an observer with a visual handicap.

The invention provides a sump pump apparatus powered by a direct current electric source for pumping liquid from a sump. The sump pump apparatus includes a pump for pumping liquid from the sump. A direct current electric motor is coupled to the pump to operate the pump thereby. A conduit is connected to the pump in order to draw liquid from the sump in response to the operation of the pump by the direct current electric motor and for discharging the liquid from the pump externally of the sump. A control mechanism is connected to the direct current electric source so as to control the operation of the pump in response to the level of liquid in the sump such that the pump is activated when the liquid is above a predetermined liquid level in the sump such that the pump is de-activated when the liquid level is below another predetermined liquid level in the sump. Finally, an alarm mechanism is connected to the electric source and in parallel to the motor to provide an intermittent visual alarm and an audible alarm when the pump is activated such that an observer is made aware of the operation of the sump pump.

It is therefore a primary object of the present invention to provide a battery-powered sump pump for pumping liquid from a sump in response to the liquid level in the sump and which provides an intermittent visual alarm and an audible alarm to an observer.

It is another object of the present invention to provide a sump pump apparatus that is powered by a battery for pumping liquids from a sump which is simple, inexpensive and yet provides an intermittent visual alarm which can be perceived by an observer who has an audible handicap.

It is a further object of the present invention to provide a sump pump apparatus powered by a direct current electric source for pumping liquid from a sump which is an auxiliary to the main sump pump and yet provides an intermittent audible alarm which can be perceived by a user having a visual handicap.

It is a still further object of the present invention to provide a battery-powered sump pump for pumping liquid from a sump which provides an intermittent alarm which may be easily perceived by an observer over and above the normal background noise experienced in every day life.

Other objects and advantages of the invention will become apparent upon reading the following detailed description and upon reference to the drawings.

DESCRIPTION OF THE PREFERRED EMBODIMENTS

Figure 1:
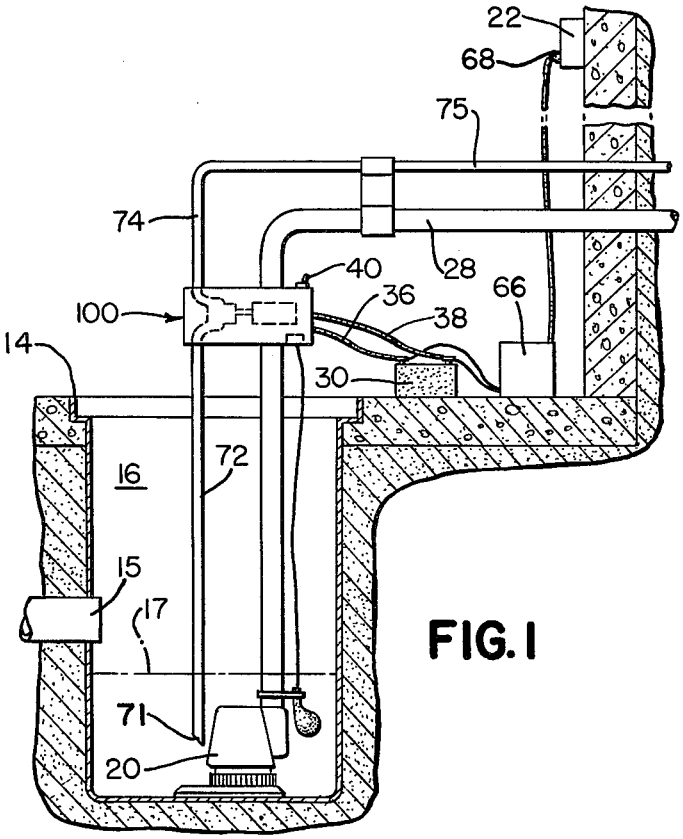
FIG. 1 is a schematic, diagrammatic, partially sectional side view of the sump pump apparatus according to my invention.

As shown in FIG. 1, the auxiliary sump pump according to my invention consists of a self-contained sump pump unit 100 which is mounted to the discharge pipe 28 of a primary sump pump by suitable clamping members. The sump pump unit 100 is placed in close proximity to the sump 14 but is physically out of the fluid receiving area 16. The sump receives fluid through a drain pipe 15. A main or primary sump pump 20 is placed in the sump, if such pump is of a submersible type. The primary sump pump is operable by a conventional alternating electrical source 22. Those skilled in the art will recognize that the primary sump pump may also be of the nonsubmersible type which is also operable by the conventional alternating electrical current source 22. The primary sump pump 20 is operable by either a float valve or a pressure responsive switch. The primary sump pump 20 is connected to the fixed discharge pipe 28 for discharging the liquid pumped by the primary sump pump 20 out of the sump 14 to a point external of the sump.

Figure 2:
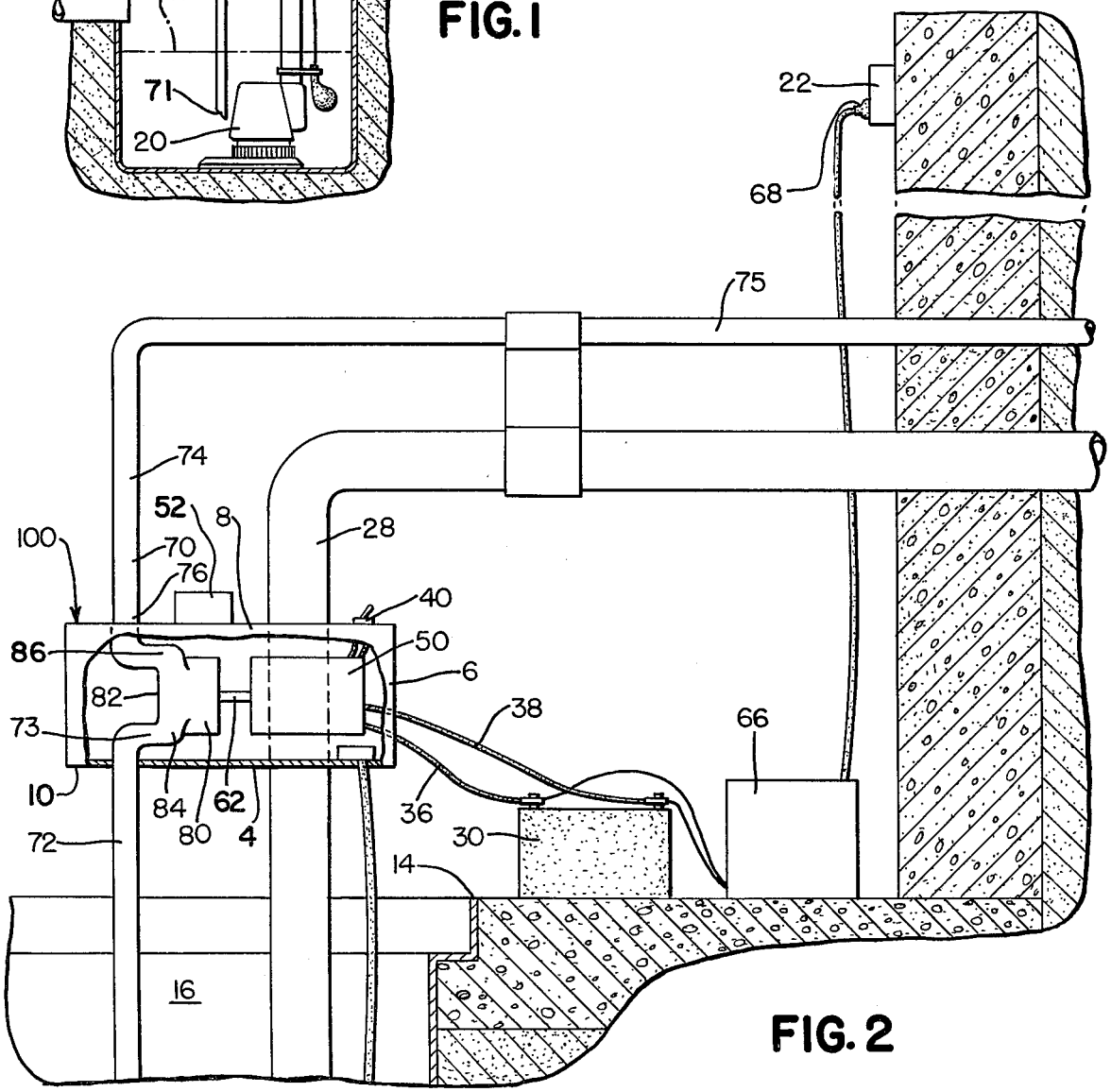
FIG. 2 is an enlarged schematic side view of the sump pump apparatus according to my invention.

As shown in FIG. 2, the unit 100 has a housing 10 which is mounted to the discharge pipe 28 by conventional fastener means, such as U-bolts, so that the unit is above the top of the sump 14. The housing 10 has a top wall 8, a side wall 6 mounted adjacent to the edge of the top wall 8 and a bottom wall 4 which is substantially parallel to the top wall 8 mounted adjacent to the edge of the side wall 6 so as to form a substantially C-shaped housing.

Figure 3:
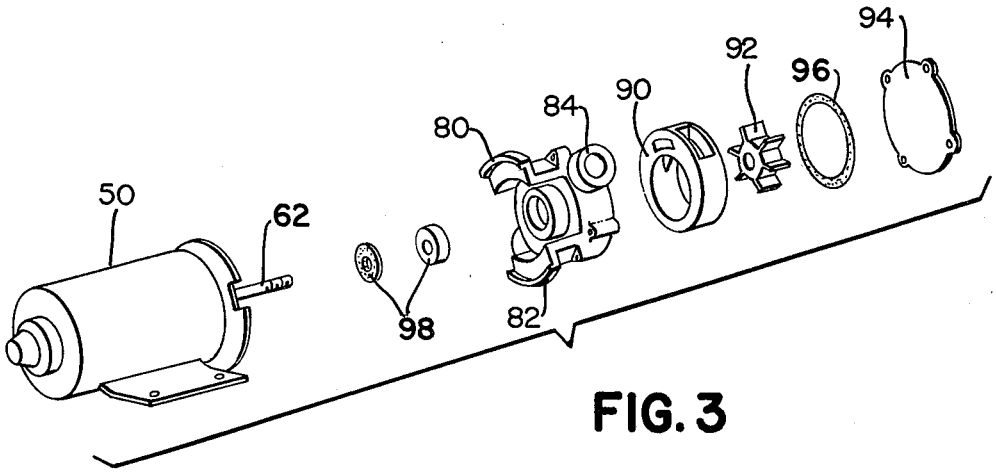
FIG. 3 is a perspective view of the pump coupled to the direct current electric source motor.

A direct current electric motor 50 is mounted to the side wall 6 by suitable conventional fasteners. The electric motor 50 has a shaft 52 extending therefrom as is shown in FIG. 3. A rotary pump 80 is mounted to the shaft 62. The pump 80 has a housing 82 with an inlet 84 and an outlet 86. The housing 82 is connected by suitable threadable connector means to the electric motor 50 to prevent movement of the housing relative to the motor. The housing 82 also has a cavity (not shown) centrally located in the housing. The cavity connects the inlet to the outlet for flow communication therebetween. An annular cam ring 90 is inserted into the cavity and is secured to the housing by suitable fasteners. An impeller member 92 is mounted within the annular cam ring 90 and is secured to the shaft 62 for rotation therewith. A cover plate 94 with a first seal means 96 encloses the cavity. The cover plate and first seal means are fastened to the housing by suitable threaded connectors. Between the housing and the electric motor, a second seal means 98 is mounted over the shaft 62 and in the housing 82 so as to prevent leakage of fluid past the shaft. When the electric motor is energized to rotate the shaft 62, the impeller member rotates with the shaft 62 and the impeller member rotates relative to the cam ring to force fluid from the inlet to the outlet of the housing.

Conduit means 70 are provided which include an inlet tube 72 and a discharge tube 74. One end 73 of the inlet tube 72 is connected to the inlet 84 of the pump. The other end 71 of the inlet tube 72 is disposed within the fluid receiving area 16 of the sump so as to be below the fluid level 17. One end 76 of the discharge tube 74 is connected to the discharge of the pump. The other end 75 of the discharge tube 74 is connected to the primary sump pump discharge pipe 28 by suitable connectors. When the other end 71 of the inlet tube is in fluid communication with the fluid within the fluid receiving area 16 of the pump of the sump 14 and when the sump pump unit 100 is activated, fluid is drawn from the sump through the inlet tube 72 by the rotation of the pump. The fluid is then discharged from the pump into the discharge tube 74 where the fluid is led to a place remote from the sump.

Figure 6:
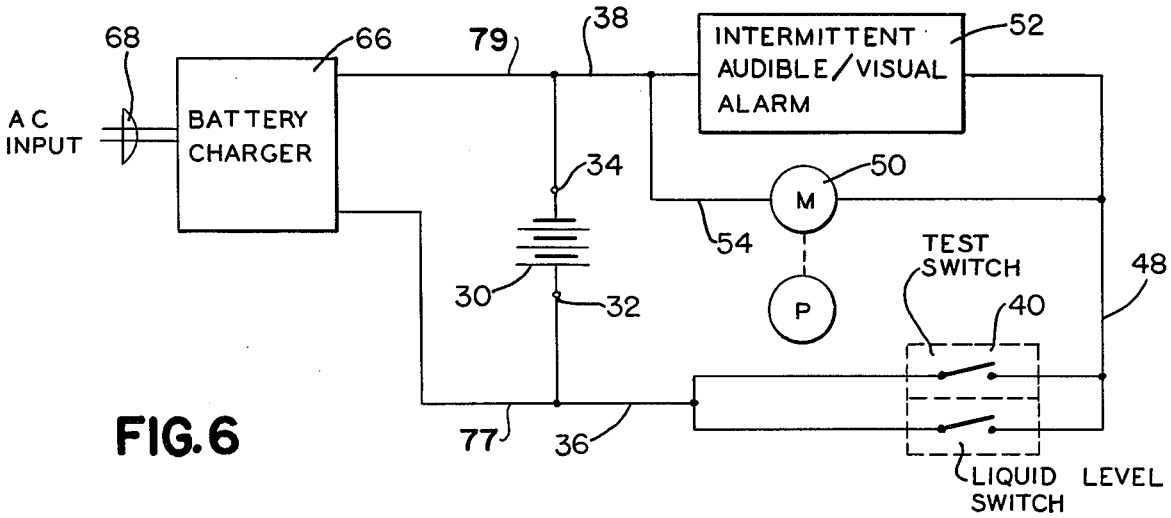
FIG. 6 is a schematic drawing illustrating the electrical control circuit for the sump pump apparatus according to my invention.

As shown in FIG. 6, the sump pump unit 100 is powered by a direct current source of electrical power 30 such as a battery. The battery has a first electric power terminal 32 and a second electric power terminal 34. A first wire 36 is connected to the first electric power terminal 32 and a second wire 38 is connected to the second terminal 34. The first wire 36 is then connected to a test switch 40 which includes a conventional on/off toggle switch which is mounted to the housing and within a hole in the top wall 8 of the housing 10 by conventional fastener means. The first wire 36 is also connected to a liquid level switch means which is connected electrically and in parallel to the test switch 40. The liquid level switch means may be a pressure sensor switch 42 or preferably a mercury float level switch 44. The liquid level switch means is used to activate its respective switch above the predetermined fluid level 17 in the fluid receiving area 16 of the sump 14. Both the liquid level switch means and the test switch 40 are mounted adjacent to the motor in the housing 10 by suitable connectors. The liquid level switch means will be described later on herein.

The liquid level switch means and test switch means are connected by a wire 48 to the direct current electric motor 50 and to one terminal of an intermittent audible/visual means 52. A wire 54 connects the output terminals of the direct current electric motor 50 with the output terminal of the intermittent audio/visual means 52. Thus the intermittent audible/visual means 52 is connected in parallel with the direct current electric motor 50. The second wire 38 connects the output terminal of the motor 50 to the second electric power terminal 34 of the direct current source of electrical power 30. The audible/visual means 52 provides an intermittent audible and visual alarm to warn or alert a person within audible distance or visual sight that the sump pump unit 100 is operational. The intermittent audible/visual means 52 may be of the type where the intermittent audible and visual signals are simultaneously produced as illustrated by the circuits of FIGS. 7 or 8 or of the type where they are alternately produced such as illustrated by FIGS. 9 or 10.

Figure 7:
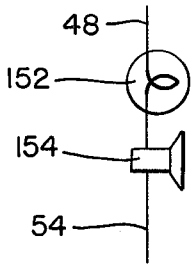
FIG. 7 is a detailed schematic drawing illustrating an alternate embodiment of the intermittent audible/visual alarm for the sump pump apparatus according to my invention.

Referring first to FIG. 7, the audible/visual means may include a flasher lamp 152, such as GE lamp number 455, connected in series with a sound producing device 154 between wires 48 and 54. The sound producing device may be a bell, buzzer or equivalent electronic device. The GE flasher lamp 455, manufactured by General Electric Company of Cleveland, Ohio, is similar to the familiar flashing Christmas tree lights. The flasher lamp has a bi-metal strip in series with the lamp's filament. Heat from the filament causes the bi-metal strip to bend, breaking the electrical continuity of the filament circuit. As the bi-metal strip cools, it returns to its original position re-establishing electrical continuity. The intermittent current flow through the filament circuit of the flasher lamp 152 simultaneously energizes the sound producing device 154 in synchronization with the flashing of the lamp.

Figure 8:
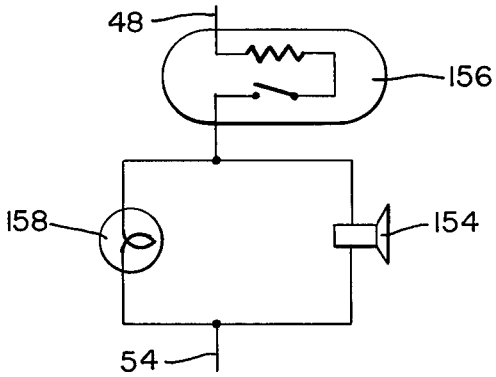
FIG. 8 is a detailed schematic drawing illustrating the preferred embodiment of the intermittent audible/visual alarm for the sump pump according to my invention.

One skilled in the art will recognize that the bi-metal strip and the filament of the flasher lamp may be independent elements as shown in FIG. 8. Referring to FIG. 8, the preferred embodiment, the lead 48 is connected to an individual flasher element 156 such as the flasher units used for the directional turn signals in automotive vehicles. The flasher element 156 is connected in series with a parallel connected lamp 158 and sound producing device 154. Each time the bi-metal strip of the flasher element closes, it completes the electrical circuit through both the lamp 158 and the sound producing device 154. Thus, the lamp 158 and the sound producing device 154 are periodically energized to produce an intermittent audible and visual alarm.

Figure 9:
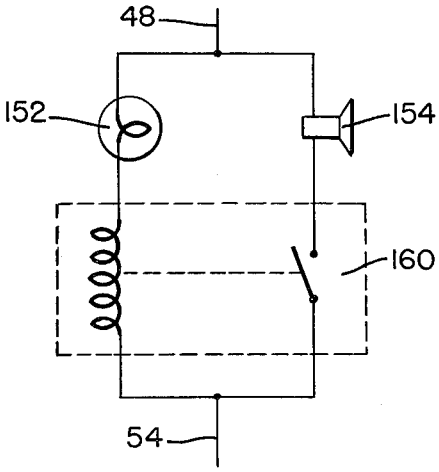
FIG. 9 is a detailed schematic drawing illustrating a second alternate embodiment of the intermittent audible/visual alarm.
Figure 10:
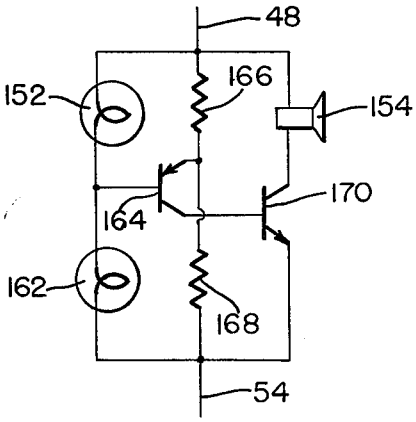
FIG. 10 is a detailed schematic drawing illustrating a third alternate embodiment of the intermittent audible/visual alarm.

Alternatively, if alternating audible and visual signals are desired, the flasher lamp 152 may be connected in series with the coil of a normally closed single pole relay 160 as shown in FIG. 9. The contacts of the relay 160 are connected in series with the sound producing device between the wires 48 and 54. The filament current through the flasher lamp 152 activates the relay 160 and de-activates the sound producing device 154. The current moving through the relay 160 causes it to open its normally closed contact thereby de-energizing the sound producing device 154. When the bi-metal strip opens, the filament circuit of the flasher lamp 152 is terminated and the relay 160 is de-energized, returning its contact to the normally closed position thus energizing the sound producing device 154. Therefore, the visual and audible signals are produced in an alternating sequence.

The relay 160 of FIG. 9 may be replaced by a transistor circuit as shown in FIG. 10. Referring to FIG. 10, the flasher lamp 152 is connected in series with a second non-flashing lamp 162. It is recognized that a resistive element may be substituted for the non-flashing lamp 162, however, the second lamp could be used to enhance the visibility of the visual signal or be placed at a remote location, such as a kitchen or other room. The base of a transistor 164 is connected to the junction between the two lamps. The emitter of the transistor 164 is connected to the centertap of a voltage divider network including resistances 166 and 168 connected between wires 48 and 54. The collector of the transistor 164 is connected to the base of a second transistor 170. The collector to the emitter terminals of the second transistor 170 are connected in series with the sound producing device 154 between the wires 48 and 54. When the bi-metal strip completes the filament circuit in the flasher lamp 152, the flasher lamp 152 and the non-flashing lamp 162 are energized and produce a visual signal. The potential at the junction between the flasher lamp 152 and the non-flashing lamp 162 back biases the transistor 164 to its nonconductive state which terminates base current to the second transistor 170 causing it also to become nonconductive and de-energizing the sound producing device 154. Opening of the filament in the flasher lamp 152 by the bi-metal strip terminates the back biasing potential at the junction between the two lamps and the transistor 164 conducts base current to the second transistor 170. The second transistor 170 will now conduct current thus energizing the sound producing device 154 to produce an audible signal. Thus, the visual and audible signals are produced in an alternating sequence. The second transistor 170 may be a single transistor or a Darlington amplifier as is known in the art.

A battery charger 66 is connected to the alternating electric source 22 by a plug connector 68. charger. Through suitable cable connectors 77, 79, a constant direct current voltage is applied to the proper first or second electric power terminal 32 and 34, respectively, of the battery 30 as the battery requires charging.

Figure 5:
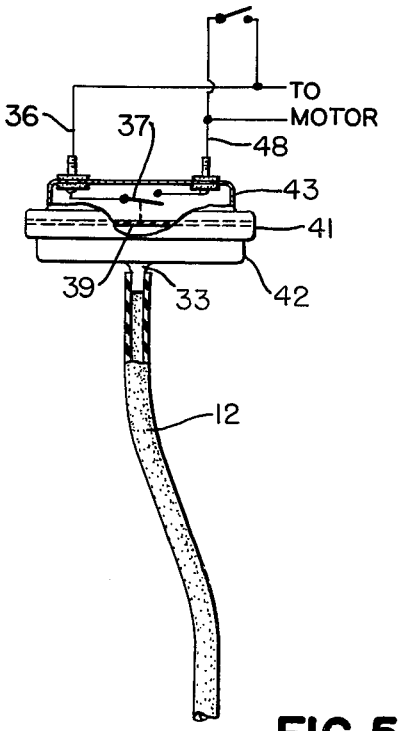
FIG. 5 is a schematic, diagrammatic side view of a pressure responsive switch.

As discussed previously, the pressure sensor switch 42 is used to activate the circuitry to energize the direct current electric motor 50. The pressure sensor switch includes a housing 41 with a receptacle 43 and a cap fitted thereto as shown in FIG. 5. A conventional pressure switch 39 is installed in the housing 41. The pressure switch 39 includes a casing with a pressure responsive diaphragm. The pressure responsive diaphragm moves in response to pressure in order to close a normally open contact 37 which is electrically connected to the first wire 36 on one side and to a wire 48 on the other side. The casing on the pressure side of the diaphragm is provided with a nipple 33 to which is connected one end of a tube 12. The other end of the tube extends into the sump 14 below the fluid level 17 in the fluid receiving area 16. Thus, air is trapped inside the tube 12 and as the liquid level of the sump rises, the air trapped in the tube 12 is compressed. The compression of the air trapped in the tube 12 transmits pressure to the diaphragm to close the normally open contact 37 when the pressure reaches a predetermined level.

Figure 4:
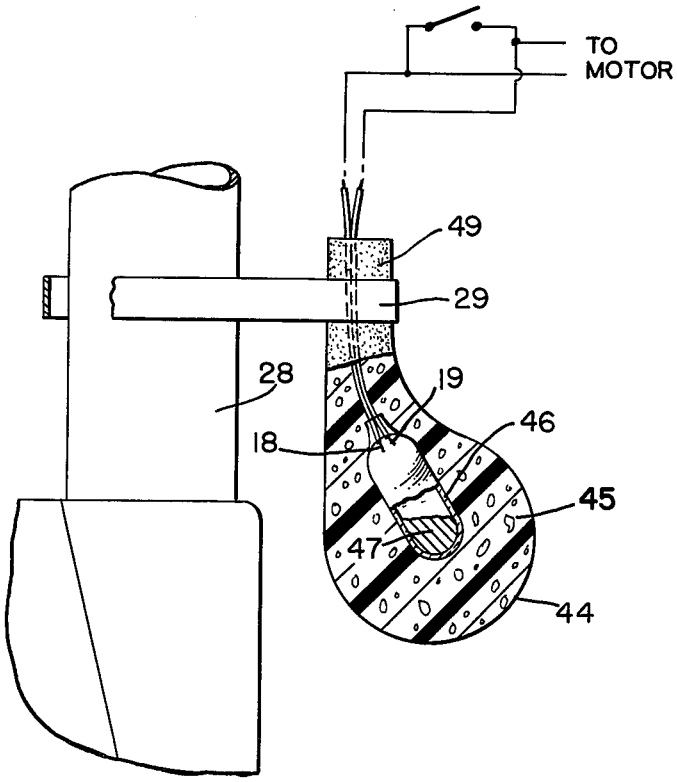
FIG. 4 is a schematic, diagrammatic side view of a liquid level sensor according to my invention.

The mercury float level switch 44 is shown in FIG. 4. A flexible tube 49 containing liquid tight current wires is positioned adjacent to the discharge pipe 28. Near the lower end of the tube 49, the mercury float level switch 44 is secured liquid tight to the tube 49. The tube 49 is secured to the discharge tube 28 by a wire or tie 29 or other suitable fastening device near the predetermined fluid level 17 that is desired to activate the sump pump unit 100. The mercury float level switch 44 includes a mercury switch 46 which is is encapsulated in a buoyant body material 45. The mercury switch 46 contains a globule of mercury 47 which is arranged to close an electrical circuit through electrodes 18 and 19. The electrical circuit through the electrodes 18 and 19 is closed by the globule of mercury 47 when the buoyant body floats upward in the liquid of the fluid receiving area 16 of the sump 14. The electrodes 18 and 19 are open when the buoyant body 45 hangs down. Thus, as is shown in FIG. 4, the switch is in a closed circuit condition as shown in the solid line, while the broken lines position the switch in an open circuit condition.

OPERATION

As the fluid level rises in the fluid receiving area 16 in the sump 14, the buoyant body 45 of the mercury float level switch 44 in the preferred embodiment causes the mercury float level switch 44 to float in the fluid. As the fluid continues to rise, the fluid level rises above the predetermined fluid level 17 thereby causing the globule of mercury 47 of the mercury switch 46 to close the electrical circuit through the electrodes 18 and 19 to close the mercury float level switch 44. This completes the electrical circuit to the direct current electric motor 50 thereby causing the motor to operate the pump 80. The impeller member 92 thus rotates relative to the armature cam ring 90 in the pump. The impeller member 92 therefore commences pumping fluid out of the fluid receiving area 16 of the sump 14 through the conduit means 70. The fluid in the sump 14 is pumped out of the fluid receiving area 16 by means of the inlet tube 72. The fluid is sucked through the inlet tube 72 into the pump 80 where the fluid is discharged by means of discharge tube 74 to a point distant from the sump 14.

At the same time, the audible/visual means is also energized to provide an intermittent audible and visual alarm to warn or alert a person within audible distance or visual sight that the sump pump unit 100 is operational. In the preferred embodiment, shown in FIG. 8, the flasher element 156 alternatingly energizes the lamp 158 and the sound producing device 154. Thus, an intermittent audible and visual alarm is produced.

The test switch 40 is used to check the operation of the sump pump unit 100 when the fluid level in the fluid receiving area 16 is below the predetermined fluid level 17. When the test switch is positioned to the on position, the electric motor becomes energized to rotate the pump 80. Thus, the user can periodically check the sump pump unit 100 to make sure that the electrical connections, switches, motor and pump are all operational.

The battery is kept fully charged by the battery charger 66. The battery charger is connected to the normal alternating current electric voltage and provides, a constant direct current voltage to the first and second electric power terminals 32 and 34 respectively of the battery.

In the alternate embodiment of the present invention, the operation is the same as in the preferred embodiment except that a pressure sensor switch 42 is used to energize the direct current electric motor 50. The pressure sensor switch 42 has a tube 12 which extends into the fluid receiving area 16 of the sump 14. As the fluid level rises, air is trapped inside the tube 12 and as the fluid level continues to rise in the fluid receiving area 16, the air trapped in the tube 12 is compressed. The compression of the air trapped in the tube 12 transmits pressure to the diaphragm to close the normally open contact 37 when the pressure reaches a predetermined level corresponding to the fluid level 17.

The operation of the sump pump unit 100 with the alternate audible/visual alarms as shown in FIGS. 7, 9 and 10 are the same as in the preferred embodiment except as noted below. With the alternate arrangement shown in FIG. 7, the flasher lamp 152 simultaneously energizes the sound producing device 154 in synchronization with the flashing of the flasher lamp 152. In the alternate arrangement shown in FIG. 9, the filament current through the flasher lamp 152 activates the relay 160. The current moving through the relay 160 causes the relay to open its normally closed contact thereby de-energizing the sound producing device 154. When the bi-metal strip of the flasher lamp opens, the filament circuit of the flasher lamp 152 is terminated and the relay 160 is de-energized. As this occurs, the contacts of the relay are returned to the normally closed position thus energizing the sound producing device 154. Finally, with the arrangement in FIG. 10, when the bi-metal strip completes the filament circuit in the flasher lamp 152, the flasher lamp 152 and the non-flashing lamp 162 are energized and produce a visual signal. The potential at the junction between the flasher lamp 152 and the non-flashing lamp 162 back biases the transistor 164 to its nonconductive state which terminates the base current to the second transistor 170 causing it also to become nonconductive and de-energizing the sound producing device 154. Opening of the filament in the flasher lamp 152 by the bi-metal strip terminates the back biasing potential at the junction between the two lamps and the transistor 164 conducts providing base current to the second transistor 170. The second transistor 170 now conducts energizing the sound producing device 154 to produce an audible signal. Thus, the visual and audible signals are produced in an alternating sequence.

While the invention has been described with reference to the above described embodiments, it is understood that various modifications can be made to the above described invention without departing from the scope of the invention. On the contrary, the invention is intended to encompass all such modifications as fall within the spirit and scope of the above described invention and the appended claims.

What is claimed is:

1. A sump pump apparatus for pumping liquid from a sump, said sump pump apparatus comprising:

submersible primary pump means, such that said submersible primary pump means is immersible within said sump, for pumping liquid from said sump;

rigid primary conduit means connected to said submersible primary pump means and extending upwardly therefrom for discharging the liquid from said submersible primary pump means externally of said sump;

primary switch means, for controlling the operation of said submersible primary pump means in response to the level of liquid in said sump such that said submersible primary pump means is activated when the liquid level in said sump is above a first predetermined minimum level and such that said submersible primary pump means is deactivated when the liquid level in said sump is below said first predetermined minimum level;

secondary pump means for pumping liquid from said sump upon failure of said submersible primary pump means, said secondary pump means being mounted to said rigid primary conduit means at a location above the top of said sump;

secondary conduit means, connected to said secondary pump means and extending downwardly therefrom into said sump, for drawing liquid from said sump in response to the operation of said secondary pump means;

tertiary conduit means connected to said secondary pump means and extending away therefrom for discharging the liquid from said secondary pump means externally of said sump;

secondary switch means, for controlling the operation of said secondary pump means in response to the level of liquid in said sump such that said secondary pump means is activated when the liquid level in said sump is above a second predetermined minimum level and such that said secondary pump means is deactivated when the liquid level in said sump is below said second predetermined minimum level, said second predetermined minimum level being higher than said first predetermined minimum level; and alarm means, connected in parallel with said secondary pump means, for providing a warning when said secondary pump means is activated.

2. The sump pump device of claim 1 wherein said alarm means further comprises:

visual means for providing a visual alarm when said secondary switch means is activated;

audible means for providing an audible alarm when said secondary switch means is activated; and means for operating said visual means and said audible means in alternating sequence such that the operation of said secondary pump means of said sump pump apparatus is indicated.

3. The sump pump apparatus of claim 1 wherein said alarm means comprises an intermittent visual and audible alarm, said alarm means comprising a flasher element connected in series with an electric lamp and means for emitting an audible sound connected in parallel with said flasher element, said flasher element periodically activating said electric lamp and said means for generating an audible sound so as to produce said intermittent visual and audible alarm.

4. The sump pump apparatus of claim 1 wherein said secondary switch means further comprises:

float switch means, mounted adjacent to said second predetermined minimum level in said sump, for closing an electrical contact to activate said secondary pump means when the liquid level rises in said sump above said second predetermined minimum level.

5. The sump pump apparatus of claim 1 further comprising a direct current electric source means and a direct current electric motor coupled to said secondary pump means to operate said secondary pump means.

6. The sump pump apparatus of claim 5, further comprising:

test switch means, mounted adjacent to said direct current electric motor, for operatively connecting said direct current electric motor to said direct electric current source means to test the operation of said sump pump apparatus and for operatively disengaging said direct current electric motor from said direct electric current source means.

7. The sump pump apparatus of claim 6 wherein said secondary switch means further comprises:

a pressure switch mounted adjacent to said secondary pump means, said pressure switch having a diaphragm means and a tube, connected to said diaphragm means, said tube having one end disposed in the liquid in said sump to trap air in said tube, said diaphragm means being responsive to an increase in air pressure in said tube when the liquid level in said sump rises such that above said second predetermined minimum level said diaphragm means closes a switch to activate said secondary pump means.

8. A sump pump apparatus for pumping liquid from a sump, said sump pump apparatus being powered by a direct electric current source means and an alternating current source means, said sump pump apparatus comprising:

submersible primary pump means having an inlet and an outlet, said inlet communicating with the liquid in said sump to draw liquid therefrom, said outlet discharging the liquid externally of said pump;

a rigid conduit having a first end and a second end, said first end being interconnected with said outlet for fluid flow therebetween, said second end extending upwardly from said submersible primary pump means to a first predetermined location remote from said sump such that said liquid pumped by said submersible primary pump means is discharged through said rigid conduit externally of said sump;

an alternating current electric motor mounted adjacent to said submersible primary pump means, said alternating current electric motor having a shaft, said shaft connected to said submersible primary pump means for rotation therewith such that said alternating current electric motor drives submersible said primary pump means;

primary switch means, for operatively connecting said alternating current electric motor to said alternating current source means at a first predetermined mininum level of said liquid in said sump so that said alternating current electric motor rotates said submersible primary pump means to draw said liquid from said sump;

secondary pump means having an inlet and an outlet, said inlet communicating with the liquid in said sump to draw liquid therefrom, said outlet discharging the liquid externally of said sump;

mounting means interposed said secondary pump means and said rigid conduit for mounting said secondary pump means to said rigid conduit at a second predetermined location therealong between said first and second ends, said second predetermined location being external of said sump;

a direct current electric motor mounted adjacent to said secondary pump means, said direct current electric motor having a shaft, said shaft being connected to said secondary pump means for rotation therewith;

secondary switch means, mounted adjacent to said direct current electric motor, for operatively connecting said direct current electric motor to said direct electric current source means at a second predetermined minimum level of the liquid in said sump so that said direct current electric motor rotates said secondary pump means to draw the liquid from said sump and for operatively disengaging said direct current electric motor from said direct electric current source means at a third predetermined minimum level of said liquid in said sump said second predetermined minimum level being above said first predetermined minimum level and said third predetermined minimum level;

secondary conduit means, connected to said secondary pump means and extending downwardly therefrom into said sump, for drawing liquid from said sump in response to the operation of said secondary pump means;

tertiary conduit means connected to said secondary pump means and extending away therefrom for discharging the liquid from said secondary pump means externally of said sump; and alarm means, connected in parallel to said direct current electric motor, for providing an intermittent visual alarm and an intermittent audible alarm when said secondary switch means is activated, said alarm means comprising a flasher element connected in series with an electric lamp and means for emitting an audible sound connected in parallel, said flasher element periodically activating said electric lamp and means for generating an audible sound to produce said intermittent visual and audible alarm.

9. The sump pump apparatus of claim 8 wherein said alarm means further comprises:

visual means for providing a visual alarm when said secondary switch means is activated;

audible means for providing an audible alarm when said secondary switch means is activated; and means for operating said visual means and said audible means in alternating sequence such that the operation of said secondary pump means of said sump pump apparatus is indicated.

10. The sump pump apparatus of claim 8 wherein said secondary switch means further comprises:

float switch means, disposed in said sump adjacent to said second predetermined minimum level, for closing an electric contact to activate said secondary pump means when the liquid level rises in said sump above said second predetermined minimum level.

11. The sump pump device of claim 10 wherein said alarm means further comprises:

bi-metallic relay means, connected to said direct electric current source means, for switching current alternatingly from one circuit to another circuit, and an audible alarm connected to one circuit of said bi-metallic relay means; and a visual alarm connected to another circuit of said bi-metallic relay means in parallel to said audible alarm, said bi-metallic relay means alternatingly providing energy for said visual alarm and said audible alarm when said bi-metallic relay means is activated.

12. The sump pump apparatus of claim 8 wherein said secondary switch means further comprises:

a pressure switch mounted adjacent said secondary pump means, said pressure switch having diaphragm means and a tube connected to said diaphragm means, said tube having one end disposed in the liquid in said sump to trap air in said tube, said diaphragm means being responsive to an increase in air pressure in said tube when the liquid level in said sump rises such that above a predetermined level said diaphragm means closes a switch to activate said secondary pump means.

13. The sump pump apparatus of claim 12 wherein said alarm means further comprises:

bi-metallic relay means, connected to said direct electric current source means, for switching current alternatingly from one circuit to another circuit, and an audible alarm connected to one circuit of said bi-metallic relay means; and a visual alarm connected to another circuit of said bi-metallic relay means in parallel to said audible alarm, said bi-metallic relay means alternatingly providing energy for said visual alarm and said audible alarm when said bi-metallic relay means is activated.

14. In a sump pump apparatus for pumping liquid from a sump, said sump pump apparatus having primary pump means, primary discharge conduit means connected to said primary pump means, said primary discharge conduit means having a discharging portion extending externally of said sump to discharge liquid drawn from said sump, for controlling the energization and de-energization of said primary pump means in response to the level of liquid in said sump exceeding a first predetermined minimum level, the improvement comprising:

secondary pump means mounted to said primary discharge conduit means external of said sump;

secondary intake conduit means connected to said secondary pump means and extending downwardly therefrom into said sump;

secondary discharge conduit means connected to said secondary pump means, said secondary discharge conduit means having a discharging portion to discharge liquid drawn from said sump by said secondary pump means externally of said sump;

electric current means;

motor means electrically connected to said electric current means and mechanically interconnected with said secondary pump means to drive said secondary pump means;

alarm means electrically connected to said electric current means and said motor means;

control means, connected to said motor means, for controlling the energization and de-energization of said motor means in response to the level of liquid in said sump exceeding a second predetermined minimum level; and means, for intermittently connecting said alarm means to said electric current means when said control means is energized such that an intermittent alarm is produced to warn that said motor means is activated, said alarm means comprising a flasher element connected in series with an electric lamp and means for emitting an audible sound connected in parallel, said flasher element periodically activating said electric lamp and means for generating an audible sound to produce said intermittent alarm.

15. The sump pump apparatus of claim 14 wherein said alarm means further comprises:

bi-metallic relay means, connected to said electric current means, for switching current alternatingly from one circuit to another circuit, and an audible alarm connected to one circuit of said bi-metallic relay means; and a visual alarm connected to another circuit of said bi-metallic relay means in parallel to said audible alarm, said bi-metallic relay means alternatingly providing energy for said visual alarm and said audible alarm when said bi-metallic relay means is activated.

* * * * *

UNITED STATES PATENT AND TRADEMARK OFFICE

CERTIFICATE OF CORRECTION

PATENT NO. : 4,456,432

DATED : June 24, 1984

INVENTOR(S) : Vincent Mannino

It is certified that error appears in the above-identified patent and that said Letters Patent is hereby corrected as shown below:

Column 8, line 16, delete "respectively".

Column 8, line 54, delete "the".

In the Claims

Column 10, line 62, delete "submers-".

Column 10, line 63, delete "ible said" and insert ---- said submersible ----.

Signed and Sealed this

*Twenty-sixth* Day of *March 1985*

[SEAL]

*Attest:*

DONALD J. QUIGG

*Attesting Officer*

*Acting Commissioner of Patents and Trademarks*